United States Patent [19]

Rath, deceased

[11] Patent Number: 4,702,420

[45] Date of Patent: Oct. 27, 1987

[54] SPRAY GUN FOR COATING MATERIAL

[75] Inventor: Anton Rath, deceased, late of Torkelhalden, Fed. Rep. of Germany, by Margaret Rath, heir

[73] Assignee: Ransburg-Gema AG, Switzerland

[21] Appl. No.: 822,480

[22] Filed: Jan. 24, 1986

[30] Foreign Application Priority Data

Feb. 1, 1985 [DE] Fed. Rep. of Germany ..... 3503384

[51] Int. Cl.[4] ..... B05B 7/00

[52] U.S. Cl. ..... 239/391

[58] Field of Search ..... 239/290, 390, 396, 397, 239/391

[56] References Cited

U.S. PATENT DOCUMENTS

| | | | |
|---|---|---|---|
| 3,208,673 | 9/1965 | Kautz | 239/289 X |
| 4,005,824 | 2/1977 | Becker et al. | 239/289 |
| 4,433,812 | 2/1984 | Grime | 239/290 |

FOREIGN PATENT DOCUMENTS

| | | | |
|---|---|---|---|
| 37910 | 10/1981 | European Pat. Off. . | |
| 2746863 | 4/1979 | Fed. Rep. of Germany | 239/290 |
| 1273722 | 9/1961 | France . | |

*Primary Examiner*—Andres Kashnikow

*Attorney, Agent, or Firm*—Ostrolenk, Faber, Gerb & Soffen

[57] ABSTRACT

A spray gun kit for dispensing coating material, for example paint, includes a common gun body and an assortment of nozzle attachment sets, each of which operates according to a unique atomization process suited for particular applications. The common gun body incorporates as many of the parts which otherwise would be repeated in each nozzle attachment. The arrangement reduces the overall cost, otherwise required, in providing an entirely assembled spray gun for each application and provides greater overall flexibility.

14 Claims, 6 Drawing Figures

SPRAY GUN FOR COATING MATERIAL

BACKGROUND OF THE INVENTION

The present invention relates to a spray gun which dispenses a coating material. The gun comprises a housing in which there is defined at least one channel through which the coating material flows and at least one gas channel. The channels lead to a connection end to which an appropriate nozzle attachment, selected from a kit of several such attachments, is secured. The nozzle attachment serves to atomize and spray the coating material.

The present invention is directed, in particular, to spray guns for spraying liquid materials, for example paint. The invention is, however, also applicable for spraying powdered coating materials.

SUMMARY OF THE INVENTION

It is an object of the present invention to provide a spray device with reduced consumption of coating material and such device which reduces the cost and expenses that would be required if coating material is to be sprayed by various different methods of atomization.

The foregoing and other objects of the present invention are achieved in accordance with the present invention by providing a spray gun, in kit form, which comes equipped with several different nozzle attachment sets. Each particular nozzle attachment set can be detachably fastened to the connection end of the spray gun. Each nozzle attachment set transforms the spray gun into a particular type of an atomization gun. Thus, with an appropriate nozzle attachment, a single spray gun housing can be used for operation in accordance with various different atomization methods. For dispensing liquid coating materials, the kit can operate according to any or more of the following methods:

(a) the compressed-air atomization method;
(b) the airless atomization method, and
(c) the airless atomization method with additional atomizer air.

For powdered coating materials, an atomizer attachment is provided for:

(a) the impact-plate atomization method, and
(b) the impact-plate-less atomization method.

Thus, a single spray gun with few interchangeable parts is adaptable for different atomization methods. The interchangeable parts comprise nozzle attachment sets to accommodate each method of atomization. The need for a separate piece of equipment for each application and the extra financial costs involved are considerably reduced.

According to the present invention, all common parts are included as part of the main housing to simplify the construction and reduce the cost of each nozzle attachment set.

The above objects as well as other objects of this invention will become readily apparent in view of the following description of the accompanying drawings.

DETAILED DESCRIPTION OF PREFERRED EMBODIMENTS

Figure 1:
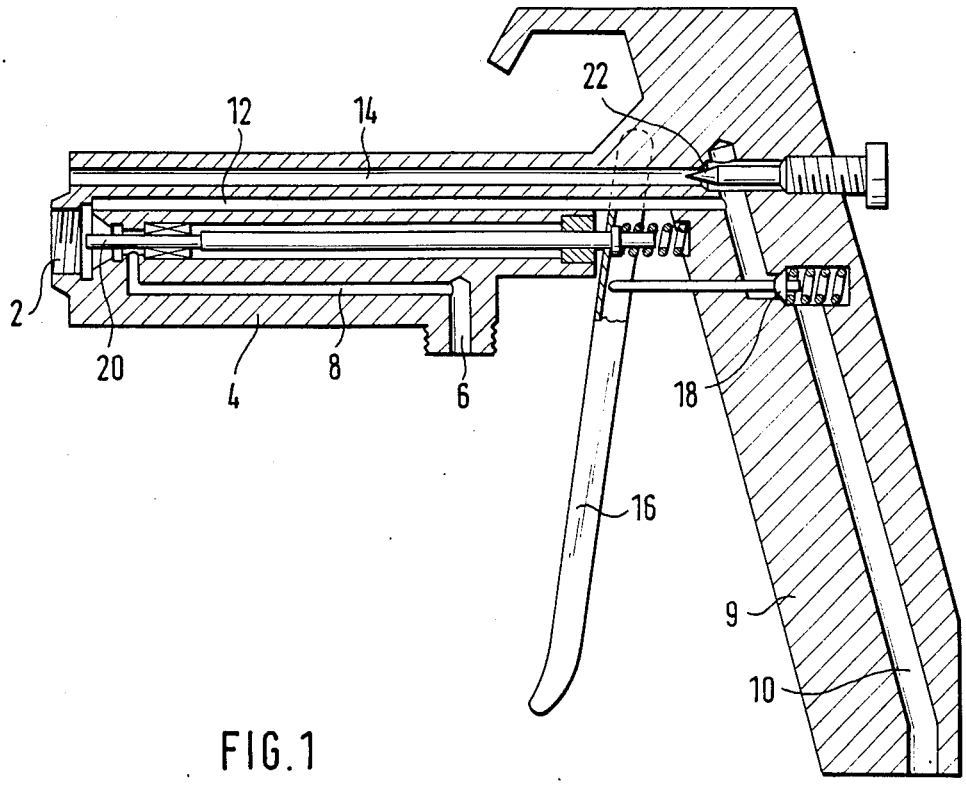
FIG. 1 is a longitudinal section through a common body of a spray gun for dispensing liquid coating material according to the invention, without a nozzle attachment set.

A spray gun, as illustrated in FIG. 1, includes a housing 4 having a connection end 2 which is depicted without a nozzle attachment set. Housing 4 defines a coating material channel 8 which extends from an inlet 6 to the downstream located connection end 2. Another inlet channel 10 extends through a pistol handle 9 which inlet channel 10 is in communication with connection end 2 via two gas channels 12 and 14 defined in housing 4. A trigger 16 actuates a valve 18 located in inlet channel 10 and also controls an actuating member 20 which will be used to control another valve located in a nozzle attachment set which will be connected to connection end 2 of housing 4. The last-mentioned valve blocks or opens the flow path for coating material from the coating-material channel 8 to the nozzle attachment set.

A flow choke 22 for adjusting the size of or entirely closing gas channel 14 is provided within the subject channel as shown. Connection end 2 of housing 4 is formed to reduce the number of parts in the attachment sets as much as possible. Several nozzle attachment sets are described below.

Figure 2:
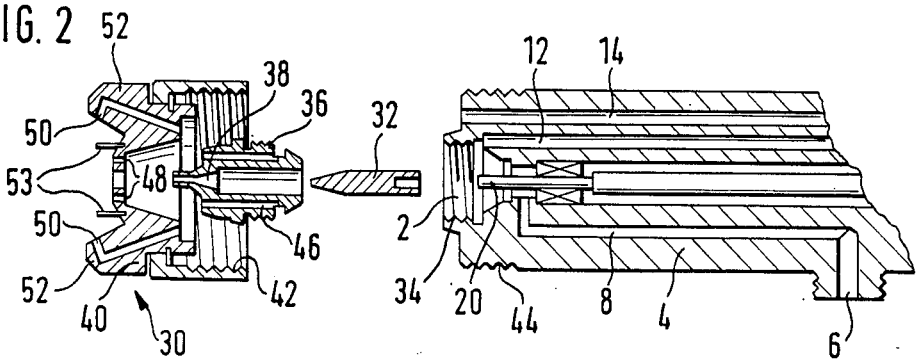
FIG. 2 depicts the connection end of the spray gun of FIG. 1 and opposite to it a nozzle attachment set for producing compressed-air atomization spraying.

The nozzle attachment set 30 of FIG. 2 includes a valve body 32 in the shape of a valve needle which can be screwed onto actuating member 20 and a separate nozzle body 36 which coaxially and symmetrically surrounds valve body 32 and which is secured to housing 4 of the spray gun by means of internal thread 34 formed in connection end 2. Nozzle body 36 has an inner valve seat for valve body 32 and an atomizer air cap 40 which grips and surrounds valve body 32 and nozzle body 36 and which is screwed to the spray gun by means of its internal thread 42 and an external thread 44 formed on connection end 2.

With nozzle attachment set 30 connected to connection end 2, coating material flows, upon actuation of trigger 16, out from channel 8 via valve 32 or 38 through nozzle body 36. Atomizer air flows in gas channel 12 and emerges via holes 46 and 48 in nozzle body 36 and atomizer air cap 40. Additional air emerges from gas channel 14 via channels 50 defined in slanted protrusions 52 of atomizer air cap 40.

Nozzle attachment set 30 in cooperation with the spray gun permit spraying of coating material in accordance with the compressed-air atomization method. Electrodes 53 on cap 40 electrostatically charge the coating material.

Figure 3:
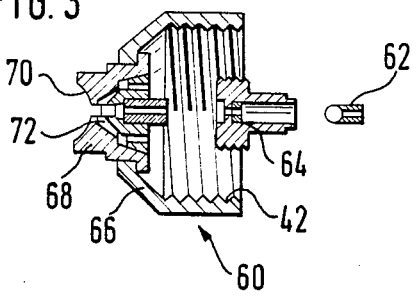
FIG. 3 shows a second nozzle attachment set for the spray gun operable in an airless atomization method with additional atomizer air.

A second embodiment identified as nozzle attachment set 60 is shown in FIG. 3. Included are a valve body 62 having a valve ball which can be screwed to actuating member 20, a valve seat 64 for said valve body which can be threadedly secured to internal thread 34 of connection end 2, and a nozzle cap 66 with internal thread 42 which is threaded onto outer thread 44 of connection end 2. When nozzle attachment set 60 has been screwed onto connection end 2 upon actuating of trigger 16, coating material emerges from channel 8 via valve body 62 and valve seat 64 through an atomizer nozzle 68 which is axially screwed into nozzle cap 66 and which operates to atomize the coating material in accordance with the airless atomization method as a result of the special, but known, shape of its nozzle mouth 70.

Additional air can enter nozzle mouth 70 from gas channel 14 via channels 72 of atomizer nozzle 68. This additional air assists in the atomization of the coating material.

Figure 4:
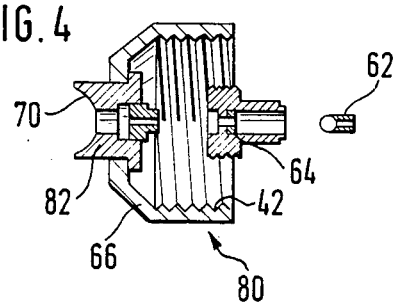
FIG. 4 shows a third nozzle attachment set for an airless atomization process.

A third nozzle attachment set 80 is illustrated in FIG. 4. It contains several parts which are identical to parts found in nozzle attachment set 60 of FIG. 3. Accordingly, corresponding parts carry identical reference numbers. The only difference between the second and third embodiments is that, instead of the atomizer nozzle 68 of FIG. 3, an atomizer nozzle 82 is inserted into nozzle cap 66 in the third embodiment of FIG. 4. Atomizer nozzle 82 has no gas channels. No air source need be connected to channel 10 of the spray gun. Flow choke 22 can remain closed. Atomization of the coating material is carried out in accordance with the airless atomization method without use of additional air.

Figure 5:
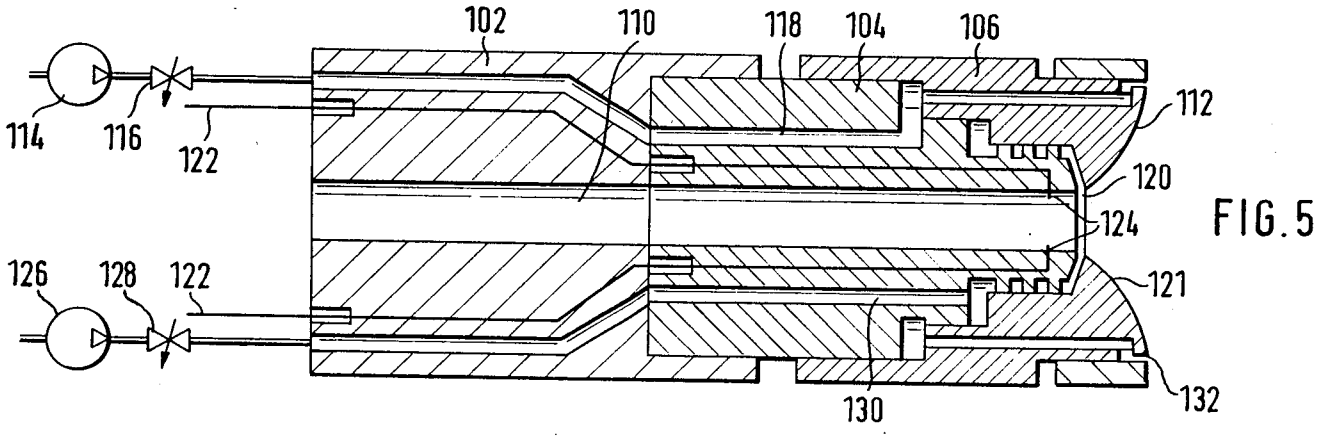
FIG. 5 is a longitudinal section through a spray gun according to the present invention which is intended for use with powdered coating materials having a nozzle attachment set for an impact-plate-less powder atomizing method.
Figure 6:
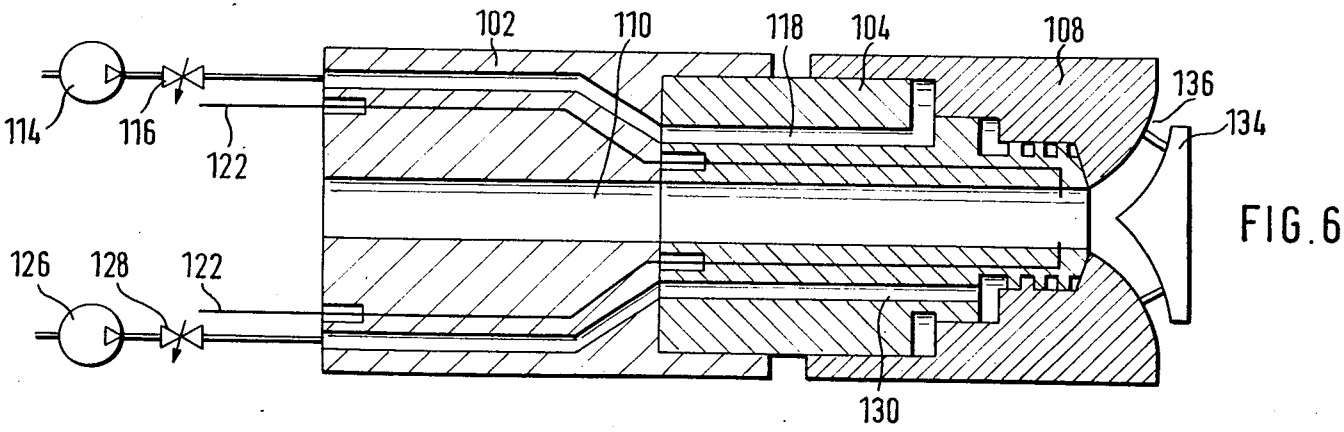
FIG. 6 shows the spray gun of FIG. 5 in which the nozzle attachment set has been replaced by a nozzle attachment set for atomization of powder by an impact-plate which deflects the powder, in accordance with the impact-plate atomization method.

Spray guns for spraying powdered coating material onto objects are shown in FIGS. 5 and 6. The construction is tubular and there are included a base body 102, a replaceable intermediate piece 104 and, as in FIG. 5, a nozzle attachment set 106 which is located on intermediate piece 104, or, as shown in FIG. 6, a replaceable nozzle attachment set 108. A coating material channel 110 extends axially through base body 102 and intermediate piece 104. Channel 110 discharges into nozzle attachment set 106 or 108.

Nozzle attachment set 106 of FIG. 5 atomizes the powdered coating material so that the stream of material produces a vacuum within nozzle mouth wall 112 in accordance with the Coanda effect, as a result of which the stream of material is torn apart radially. Atomization is supported by atomization air which is supplied from an external source of compressed air 114 via shut-off valve 116 and is to a gas channel 118 of the spray gun and flows via an outlet 120 into nozzle mouth 121. The atomization takes place in accordance with the well-known impact-plate-less atomization method. Electric wires 122 are connected to electrodes 124 which are arranged in material channel 110 to electrostatically charge the coating material.

Another source of gas 126 supplies compressed air via a shut-off valve 128 to another gas channel 130 from which the air emerges via an annular slot nozzle 132 to form a jacket of gas which surrounds and contains the atomized coating material.

The nozzle attachment set 108 of FIG. 6 closes gas channels 118 and 130, and the atomization of the coating material is effected by an impact member 134 which blocks the coating material flow path downstream of nozzle wall 136. The presently described embodiment does not require compressed air and compressed air sources 114 and 126 can be disconnected. Nozzle attachment set 108 of FIG. 6 operates in accordance with the well-known impact-plate atomization method.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A spray gun for dispensing coating material, comprising:

a gun body having a housing which defines a first group of channels which include at least one material channel for passage therethrough of coating material and at least one gas channel for atomization gas, the housing having a nozzle connection end;

a detachable plurality of nozzle attachment sets each connectable to the connection end of the housing, each nozzle attachment set having a respective housing which defines a second group of channels which include at least one material channel, the channels in the gun body housing being arranged to align with the channels in the detachable nozzle set; and means for securing a selected nozzle of the nozzle set to the gun body.

2. The spray gun as in claim 1, in which each nozzle attachment set comprises a valve for passage therethrough of the coating material and wherein the housing of the set comprises an actuating device for actuating the valve in each individual nozzle of the attachment set.

3. A spray gun as in claim 2, in which the detachable nozzle set includes means for atomization of a liquid in accordance with a compressed-air atomization method.

4. A spray gun as in claim 2, in which the detachable nozzle set includes means for atomization of a liquid in accordance with an airless atomization method.

5. A spray gun as in claim 4, in which the nozzle set comprises a nozzle cap having threaded portions for threaded securement thereof to the housing of the spray gun and an atomizer nozzle secured to the nozzle cap, the nozzle cap comprising a housing around the valve of the nozzle set.

6. A spray gun as in claim 2, in which the detachable nozzle set includes means for atomization of a liquid in accordance with an airless atomization method using supplemental atomization air.

7. A spray gun as in claim 1, in which the nozzle set includes means for atomizing powdered coating material in accordance with an impact-plate atomization method.

8. A spray gun as in claim 1, in which the nozzle set includes means for atomizing powdered coating material in accordance with an impact-plate-less atomization method.

9. A spray gun kit for dispensing coating material, comprising:

a gun body having a housing which defines a first group of channels which include at least one material channel for passage of coating material therethrough and at least one gas channel for atomization gas, the housing having a nozzle connection end;

a plurality of nozzle attachment sets, each of the nozzle attachment sets being securable to the connection end of the housing on a mutually exclusive basis, each nozzle attachment set having a respective housing which defines a second group of channels which include at least one material channel, each one of the plurality of nozzle attachment sets including a means for atomizing the coating material in accordance with unique method of atomization; and means in each of the nozzle attachment sets and in the gun body for securing the nozzle set to the gun body and for mating thereof to each other to permit the coating material and the atomization gas, as necessary, to flow into the nozzle attachment set that is connected to the gun body.

10. A spray gun for dispensing coating material, comprising:

a gun body having a housing which defines a first group of channels which include at least one material channel for passage therethrough of coating material and at least one gas channel for atomization gas, the housing having a nozzle connection end;

a plurality of detachable nozzle attachment sets each connectable to the connection end of the housing, each nozzle attachment set having a respective housing which defines a second group of channels which include at least one material channel, the channels in the gun body housing being arranged to align with the channels in the detachable nozzle attachment set; and means for securing the nozzle attachment set to the gun body;

each nozzle attachment set comprising a valve for passage therethrough of the coating material and wherein the gun body housing comprises an actuating device for actuating the valve in the respective nozzle attachment set;

a first one of the nozzle attachment sets including first means for atomization of a liquid in accordance with a compressed-air atomization method;

a second one of the nozzle attachment sets further including second means for atomization of a liquid in accordance with an airless atomization method;

a third one of the nozzle attachment sets including third means for atomization of a liquid in accordance with an airless atomization method using supplemental atomization air.

11. A spray gun as in claim 10, in which the nozzle set comprises an atomization air cap with internal threads for being threadedly secured to the housing and a nozzle located within the atomization air cap and in communication with the valve of the nozzle attachment set.

12. A spray gun as in claim 10, in which the housing defines an additional channel for supplying additional atomization air and in which the nozzle attachment set comprises a nozzle cap with threads for threaded securement thereof to the housing of the spray gun and an atomization nozzle secured to the nozzle cap, the valve of the nozzle set being enclosed within the nozzle cap.

13. A spray gun as in claim 10, in which the nozzle set comprises at least one electrical electrode for electrostatic charging of the coating material.

14. A spray gun for dispensing coating material, comprising:

a gun body having a housing which defines a first group of channels which include at least one material channel for passage therethrough of coating material and at least one gas channel for atomization gas, the housing having a nozzle connection end;

a plurality of detachable nozzle attachment sets each connectable to the connection end of the housing, each nozzle attachment having a respective housing which defines a second group of channels which include at least one material channel, the channels in the gun body housing being arranged to align with the channels in the detachable nozzle set; and means for securing the nozzle set to the gun body;

a first one of the nozzle attachment sets including means for atomizing powdered coating material in accordance with an impact-plate atomization method;

a second one of the nozzle attachment sets including means for atomizing powdered coating material in accordance with an impact-plate-less atomization method.

* * * * *